United States Patent [19]

Schenker et al.

[11] Patent Number: 4,935,159

[45] Date of Patent: Jun. 19, 1990

[54] USE OF AMINE ETHERS AS WETTING AGENTS FOR TEXTILES

[75] Inventors: Gilbert Schenker, Erkrath; Andreas Syldatk, Duesseldorf; Robert Piorr, Ratingen-Hoesel, all of Fed. Rep. of Germany

[73] Assignee: Henkel Kommanditgesellschaft auf Aktien, Duesseldorf, Fed. Rep. of Germany

[21] Appl. No.: 264,421

[22] Filed: Oct. 31, 1988

[30] Foreign Application Priority Data

Oct. 31, 1987 [DE] Fed. Rep. of Germany ..... 3737071

[51] Int. Cl.[5] ..... C11D 3/12; C11D 3/30

[52] U.S. Cl. ..... 252/99; 252/102; 252/526; 252/527; 252/529; 252/548; 252/174.25; 8/137

[58] Field of Search ..... 252/529, 548, 174.25, 252/174.21, 546, 545, 99, 95

[56] References Cited

U.S. PATENT DOCUMENTS 4,600,523 7/1986 Piorr et al. ..... 252/174.22

4,719,044 1/1988 Piorr et al. ..... 252/548

FOREIGN PATENT DOCUMENTS 70079 1/1983 European Pat. Off. .

137669 4/1985 European Pat. Off. .

2543941 4/1976 Fed. Rep. of Germany .

2544242 4/1976 Fed. Rep. of Germany .

2752658 8/1978 Fed. Rep. of Germany .

*Primary Examiner*—Prince E. Willis

*Attorney, Agent, or Firm*—Ernest G. Szoke; Wayne C. Jaeschke; Real J. Grandmaison

[57] ABSTRACT

Long-chain hydroxyalkyl ether amines corresponding to the general formula $$R^1—CHOH—CH_2—(O—CH_2—CH_2—)_xNR^2R^3$$

are suitable as wetting agents for textile products of all kinds and are distinguished by particularly low-foaming behavior. In the formula, $R^1$ is a linear $C_6$–$C_{22}$ alkyl group, $R^2$ and $R^3$ independently of one another represent a linear or branched $C_1$–$C_6$ alkyl radical, and x is a number of 3 to 20.

9 Claims, No Drawings

USE OF AMINE ETHERS AS WETTING AGENTS FOR TEXTILES

BACKGROUND OF THE INVENTION

1. Field of the Invention:

This invention relates to the use of long-chain hydroxyalkyl ether amines as low-foaming wetting agents in aqueous baths intended for the treatment of textiles.

2. Discussion of Related Art:

In the various stages involved in the production, processing and use of textiles, both the textile intermediates, such as filaments and yarns, and the woven fabrics and non-wovens produced from them and the end products are treated with aqueous baths of various kinds. Examples of such treatments include the bleaching of fibers and fabrics, the finishing of fabrics, the dyeing of yarns and fabrics and the washing of textile end products. In general, it is desirable in this regard to bring the aqueous bath into intimate contact with the textile materials as quickly as possible and, for this reason, wetting agents are added to the aqueous baths to accelerate this process. It is preferred, above all in the institutional sector, to use wetting agents which generate very little foam in order to avoid problems, particularly where high-speed machines are used. However, a good wetting effect and low foaming do not go hand in hand; on the contrary, the majority of commercially readily available wetting agents show a distinct and, often, excessive tendency towards foaming. Despite many new developments in the field of wetting agents, therefore, the search for, overall, more suitable products still goes on.

An object of the present invention is to improve the wetting effect and to minimize foaming in the treatment of textiles with aqueous baths. It has been found that this object can be achieved by the use of certain long-chain hydroxyalkyl ether amines in textile treatment baths.

DESCRIPTION OF INVENTION

Other than in the operating examples, or where otherwise indicated, all numbers expressing quantities of ingredients or reaction conditions used herein are to be understood as modified in all instances by the term "about".

The present invention relates to the use of long-chain hydroxyalkyl ether amines corresponding to general formula I:

$$R^1—CHOH—CH_2—(O—CH_2—CH_2—)_xN\ R^2\ R^3 \qquad (I)$$

in which $R^1$ comprises a linear $C_6$–$C_{22}$ alkyl group, $R^2$ and $R^3$ independently of one another represent a linear or branched $C_1$–$C_6$ alkyl radical, and x is a number of from about 3 to about 20, as a wetting agent for textiles. In the context of the invention textiles are understood to include not only textile end products, such as articles of clothing or carpets, but also the preliminary and intermediate products of textiles, such as fibers, yarns, woven fabrics, knitted fabrics and nonwovens.

In a preferred embodiment of the invention, hydroxyalkyl ether amines are used in which $R^1$ is a linear $C_8$–$C_{14}$ alkyl group, $R^2$ and $R^3$ independently of one another represent a linear or branched $C_2$–$C_5$ alkyl radical and x is a number of from about 3 to about 10. Hydroxyalkyl ether amines in which $R^1$ contains 10 to 12 carbon atoms and $R^2$ and $R^3$ represent n-butyl radicals, are particular preferred.

The process for the wetting of textiles which is carried out using the wetting agents according to the invention comprises treating the textiles with an aqueous bath which preferably contains from 5 to 50,000 ppm, and more preferably from 20 to 20,000 ppm, of the wetting agents according to the invention. In general, the treatment process is integrated into one of usual textile treatment processes, i.e. the wetting agents according to the invention are used together with other active substances necessary for the textile treatment processes. Thus, the wetting agents according to the invention may be used with advantage in the following textile treatment processes: spinning processes, finishing of fibers, carbonization of wool, washing of fibers and fabrics, boiling of cotton, bleaching of fibers and fabrics, mercerization, antistatic finishing, dyeing, printing, softening, and washing of textile end products.

In many of these processes, advantages are afforded by the high resistance of the wetting agents according to the invention to acids and alkalis in addition to their high wetting power and the substantial absence of foam to the point of foamlessness. Other positive properties, such as for example remarkable washing power, are also useful in the practical application of the wetting agents according to the invention.

In the processes mentioned above, the wetting agents according to the invention may be used together with the active substances and auxiliaries normally used in such processes, including pH regulators, particularly alkali metal hydroxides and alkaline-reacting salts; emulsifiers (surfactants), preferably of the anionic and nonionic type, for example alkyl benzenesulfonates, paraffin sulfonates, ester sulfonates, alkyl sulfates, alkyl ether sulfates, ethylene oxide adducts with long-chain alcohols and alkylphenols; complexing agents, such as sodium tripolyphosphate, ethylenediamine tetraacetic acid (EDTA), nitrilotriacetic acid (NTA) and ethylenediamine-tetramethylenephosphonic acid (EDTMP); bleaches, particularly oxidizing agents, such as for example hydrogen peroxide and sodium chlorite; stabilizers, such as gluconate or magnesium silicate; activators, such as sodium silicates or organic acylating agents; sizes, particularly starch and starch derivatives, cellulose derivatives, polyvinyl alcohol and polyacrylates; precursors of textile finishing resins; dyes; levelling agents; fixing agents; optical brighteners; pigments; softening substances, such as for example long-chain quaternary ammonium compounds; detergent builders, particularly sodium triphosphate, sodium alumino silicate and sodium carbonate; redeposition inhibitors, such as for example carboxymethyl cellulose, methyl cellulose and polymeric carboxylic acid; foam regulators and typical accompanying components, for example inorganic salts.

In their practical application, the wetting agents according to the invention may be used as the sole wetting agent or in combination with other wetting agents and surfactants. In the latter case, it is an advantage that the wetting agents according to the invention have a foam-inhibiting effect on other surface-active substances, so that in many cases there is no need to use foam inhibitors.

To prepare the aqueous bath used in the wetting process according to the invention, the wetting agents and the other active substances and auxiliaries may be separately added, although it is often best for the mixture of active substances and auxiliaries to be prepared in advance in solid or concentrated form. Accordingly, the present invention also relates to correspondingly preblended preparations, particularly for the washing of textiles.

In addition to the wetting agent according to the invention being present in a quantity of 0.1 to 15% by weight, a typical textile detergent contains for example 3 to 50% by weight of a builder, preferably a sodium alumino silicate capable of ion exchange, more especially zeolite NaA, as another essential active constituent.

A particularly suitable textile detergent has the following composition:

0.2 to 10% by weight and preferably 0.5 to 5% by weight of wetting agent according to the invention, 0 to 10% by weight and preferably 0.5 to 5% by weight of anionic and/or nonionic surfactant, 5 to 40% by weight and preferably 8 to 30% by weight of zeolite NaA, 0 to 10% by weight and preferably 0.5 to 5% by weight of complexing agent selected from the group consisting of NTA, EDTA, EDTMP and mixtures thereof, 0 to 30% by weight and preferably 5 to 25% by weight of sodium triphosphate, 0 to 40% by weight and preferably 5 to 25% by weight of a bleaching agent selected from the group consisting of perborates, percarbonates and mixtures thereof, 0 to 5% by weight and preferably 0.3 to 3% by weight of redeposition inhibitors, 0 to 20% by weight and preferably 1 to 10% by weight of alkaline-reacting salts selected from the group consisting of sodium silicates, sodium carbonates and mixtures thereof, 0 to 15% by weight and preferably 0.2 to 8% by weight of auxiliaries selected from the group consisting of bleach activators, enzymes, optical brighteners, dyes, perfume, foam inhibitors and mixtures thereof, and ad 100 % other conventional accompanying components and water.

The hydroxyalkyl ether amines to be used in accordance with the invention may be prepared in various ways The amines are preferably prepared by the method described in earlier German patent application 36 14 834.2 from dialkyl amines, ethylene oxide and long-chain $\alpha$-epoxides. diisopropyl amine, dibutyl amine and diisobutyl amine. The secondary amines are reacted in known manner with ethylene oxide in a molar ratio of 1:3 to 1:20 and the ether amines formed are reacted with long-chain $C_8$–$C_{24}$ epoxides, preferably in the presence of alkaline catalysts. The molar ratio of ethoxylated secondary amine to epoxide is approximately 1:1. The reaction is carried out by heating several hours at a temperature of 140° to 180° C. in the presence of 0.1 to 1% by weight, based on the quantity of epoxide, of alkaline catalyst. It is clear from the production process that the value x in formula I is generally an average value of whole numbers.

EXAMPLES

1. Testing of wetting properties:

The wetting power of the hydroxyalkyl ether amines was tested by the immersion wetting method according to DIN 53 901. This method comprises measuring the time which elapses before a cotton fabric immersed in the solution of wetting agent begins to sink.

The following state-of-the-art wetting agents were used for comparison:

(A) linear dodecyl benzenesulfonate, sodium salt (B) $C_{12}$–$C_{14}$ fatty alcohol +2 EO sulfate, sodium salt (C) tallow fatty acid methyl ester sulfonate, sodium salt (D) coconut oil fatty alcohol +7 EO (E) coconut oil fatty acid diethanolamide.

The follow hydroxyalkyl ether amines corresponding to formula I were tested:

| | $R^1$ | $R^2$, $R^3$ | X |
|---|---|---|---|
| I | $C_{10}$ | n-butyl | 3 |
| II | $C_{10}$ | n-butyl | 5 |
| III | $C_{10}$ | n-butyl | 7 |
| IV | $C_{10}$ | n-butyl | 10 |
| V | $C_{12}$ | n-butyl | 3 |
| VI | $C_{12}$ | n-butyl | 5 |
| VII | $C_{12}$ | n-butyl | 7 |
| VIII | $C_{12}$ | n-butyl | 10 |

The following wetting times (in seconds) were obtained for in-use concentrations of 0.5 and 1.0% by weight in distilled water and water having a hardness of 16°Gh (German hardness) at 25° C.:

| Wetting agent | Distilled water | | Water 16° Gh | |
|---|---|---|---|---|
| | 0.5% | 1.0% | 0.5% | 1.0% |
| I | 52 | 33 | 88 | 15 |
| II | 25 | 20 | 86 | 14 |
| III | 64 | 14 | 151 | 26 |
| IV | 83 | 36 | 185 | 67 |
| V | 120 | 49 | 50 | 43 |
| VI | 43 | 25 | 60 | 21 |
| VII | 226 | 89 | 160 | 52 |
| VIII | 300 | 159 | 262 | 139 |
| A | 27 | 9 | 35 | 10 |
| B | 68 | 28 | 69 | 24 |
| C | 155 | 82 | 190 | 80 |
| D | 71 | 30 | 81 | 36 |
| E | 56 | 19 | 49 | 12 |

The results clearly show that the wetting times obtained where the hydroxyalkyl ether amines according to the invention are used are as short as those obtained with the state-of-the-art wetting agents.

2. Testing of foaming behavior:

This test was carried out with the same substances as in Example 1 in a "beaten" foam apparatus according to DIN 53, 902, Part 1. Solution of the wetting agent in a standing cylinder is beaten for 30 seconds with a perforated plate and the volume of foam formed is read off after various times. The test produced the following results (in $cm^3$ foam volume after x minute ($V_x$)) for a wetting agent concentration of 0.5% by weight (5000 ppm) in distilled water and in water having a hardness of 16°Gh at a temperature of 40° C.:

| Wetting agent | Distilled water | | | Water 16° Gh | | |
|---|---|---|---|---|---|---|
| | $V_0$ | $V_{10}$ | $V_{20}$ | $V_0$ | $V_{10}$ | $V_{20}$ |
| I | 0 | 0 | 0 | 0 | 0 | 0 |
| II | 0 | 0 | 0 | 0 | 0 | 0 |
| III | 0 | 0 | 0 | 0 | 0 | 0 |
| IV | 0 | 0 | 0 | 0 | 0 | 0 |
| V | 10 | 5 | 5 | 0 | 0 | 0 |
| VI | 10 | 5 | 0 | 5 | 0 | 0 |
| VII | 5 | 0 | 0 | 5 | 0 | 0 |
| VIII | 10 | 10 | 5 | 10 | 5 | 5 |
| A | 400 | 350 | 350 | 100 | 90 | 90 |
| B | 400 | 400 | 400 | 320 | 300 | 200 |
| C | 350 | 300 | 250 | 20 | 10 | 5 |

-continued

| Wetting agent | Distilled water | | | Water 16° Gh | | |
|---|---|---|---|---|---|---|
| | $V_0$ | $V_{10}$ | $V_{20}$ | $V_0$ | $V_{10}$ | $V_{20}$ |
| D | 100 | 100 | 80 | 100 | 100 | 80 |
| E | 50 | 30 | 20 | 40 | 20 | 20 |

It is clear from the results shown above that the hydroxyalkyl ether amines according to the invention are far superior to the state-of-the-art wetting agents in regard to low foaming behavior.

3. Use as wetting agents in the cold pad-batch bleaching of cotton fabrics:

In a 15 meter vertical impregnating compartment, cotton twill having a mass per unit area of 267 g/m$^2$ (sized with a combination of synthetic size and natural starch) was impregnated at 80 meters per minute/15° C. with an aqueous solution containing the following active substances:

Per liter:

50 ml hydrogen peroxide (35%)
12 g NaOH
15 ml waterglass 37/40°Be
8 g wetting agent of Example 1, III
5 g sodium persulfate
0.1 g $MgSO_4$ In this process, the bath uptake is 85%, based on the weight of the fabric. After a residence time of 20 hours at room temperature, the fabric was washed and dried in the usual way.

We claim:

1. A process for the wetting of a textile in an aqueous bath, consisting essentially of adding to said bath a long-chain hydroxyalkyl ether amine corresponding to the following formula (I)

$$R^1—CHOH—CH_2—(O—CH_2—CH_2—)_xN\ R^2R^3 \quad (I)$$

in which $R^1$ comprises a linear $C_{6-C22}$ alkyl group, $R^2$ and $R^3$ independently of one another represent a linear or branched $C_1$–$C_6$ alkyl radical, and x is a number of from about 3 to about 20.

2. A process as in claim 1 wherein $R^1$ is a linear $C_8$–$C_{14}$ alkyl group, $R^2$ and $R^3$ independently of one another represent a linear or branched $C_2$–$C_5$ alkyl radical, and x is a number of from about 3 to about 10.

3. A process as in claim 1 wherein $R^1$ is a linear $C_{10}$–$C_{12}$ alkyl group, and $R^2$ and $R^3$ represent n-butyl radicals.

4. A process as in claim 1 wherein said hydroxyalkyl ether amine is present in said aqueous bath in a concentration of from about 5 to about 50,000 ppm.

5. A process as in claim 1 wherein said aqueous bath also contains at least one other wetting agent or surfactant.

6. A textile detergent composition consisting essentially of about 0.2 to about 10% by weight of a long-chain hydroxyalkyl ether amine corresponding to the following formula (I):

$$R^1—CHOH—CH_2—(O—CH_2—CH_2—)_xN\ R^2R_3 \quad (I)$$

in which $R^1$ comprises a linear $C_6$–$C_{22}$ alkyl group, $R^2$ and $R^3$ independently of one another represent a linear or branched $C_1$–$C_6$ alkyl radical, and x is a number of from about 3 to about 20, 0 to 10% by weight of anionic or nonionic surfactant,
5 to 40% by weight of zeolite NaA,
0 to 10% by weight of complexing agent selected from the group consisting of nitrilotriacetic acid, ethylenediamine tetraacetic acid, ethylenediamine tetramethylene phosphonic acid, and mixtures thereof,
0 to 30% by weight of sodium triphosphate,
0 to 5% by weight of a redeposition inhibitor,
0 to 20% by weight of an alkaline-reacting salt selected from the group consisting of sodium silicates, sodium carbonates and mixtures thereof and
0 to 15% by weight of auxiliaries selected from bleach activators, enzymes, optical brighteners, dyes, perfume, foam inhibitors and mixtures thereof.

7. A composition as in claim 6 wherein $R^1$ is a linear $C_8$–$C_{14}$ alkyl group, $R^2$ and $R_3$ independently of one another represent a linear or branched $C_2$–$C_5$ alkyl radical, and x is a number of from about 3 to about 10.

8. A composition as in claim 6 wherein $R^1$ is a linear $C_{10}$–$C_{12}$ alkyl group, and $R^2$ and $R^3$ represent n-butyl radicals.

9. A composition as in claim 6 containing 0.5 to 5% by weight of said ether amine, 0.5 to 5% by weight of anionic or nonionic surfactant,
8 to 30% by weight of zeolite NaA,
0.5 to 5% by weight of complexing agent selected from the group consisting of nitrilotriacetic acid, ethylenediamine tetraacetic acid, ethylenediamine tetramethylenephosphonic acid, and mixtures thereof,
5 to 25% by weight of sodium triphosphate,
5 to 25% by weight of a bleaching agent selected from the group consisting of perborates, percarbonates and mixtures thereof,
0.3 to 3% by weight of a redeposition inhibitor,
1 to 10% by weight of an alkaline-reacting salt selected from the group consisting of sodium silicates, sodium carbonates and mixtures thereof,
0.2 to 8% by weight of auxiliaries selected from bleach activators, enzymes, optical brighteners, dyes, perfume, foam inhibitors and mixtures thereof.

* * * * *